US006305340B1

(12) United States Patent
Furuya

(10) Patent No.: US 6,305,340 B1
(45) Date of Patent: Oct. 23, 2001

(54) SLANTED INTERNAL COMBUSTION ENGINE

(75) Inventor: Akira Furuya, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/461,550

(22) Filed: Dec. 14, 1999

(51) Int. Cl.[7] ..... F02F 7/00
(52) U.S. Cl. ..... 123/195 AC; 123/195 C
(58) Field of Search ..... 123/195 R, 195 HC, 123/309, 58.1, 193.2, 195 AC, 90.39, 90.27, 90.31, 195 C, 198 E, 90.25, 90.26

(56) References Cited

U.S. PATENT DOCUMENTS 4,223,647 * 9/1980 Castarede ..... 123/58.1
4,692,123 * 9/1987 Tada et al. ..... 440/77
5,884,593 * 3/1999 Immel et al. ..... 123/90.23
5,887,563 * 3/1999 Shudo et al. ..... 123/196 R
5,960,751 * 10/1999 Isoshima ..... 123/58.1
5,992,355 * 11/1999 Shichinohe et al. ..... 123/41.56

FOREIGN PATENT DOCUMENTS 4362270 12/1992 (JP) .
10280932 10/1998 (JP) .

* cited by examiner

*Primary Examiner*—Noah P. Kamen
*Assistant Examiner*—Hai Huynh
(74) *Attorney, Agent, or Firm*—Martin A. Farber

(57) ABSTRACT

An internal combustion engine of which a cylinder is slanted toward a crankcase, comprises intake and exhaust valves provided in a cylinder head and below a combustion chamber and a camshaft provided below the intake and exhaust valves for driving the intake and exhaust valves through a rocker arm.

15 Claims, 2 Drawing Sheets

SLANTED INTERNAL COMBUSTION ENGINE

BACKGROUND OF THE INVENTION

1. Field of the Invention

The present invention relates to an internal combustion engine, and more particularly, to an internal combustion engine of which a cylinder axis is slanted.

2. Background Art

Variety of internal combustion engines whose cylinders axes are slanted with respect to a vertical axis have been proposed to reduce the overall height of the engines.

For example, Japanese Patent Application Laid-open No. Toku-Kai-Hei 4-362270 discloses a slanted SOHC (Single Over-Head Cam) internal combustion engine of which a camshaft is provided above the cylinder axis so that the intake and exhaust valve train is disposed at a low position.

Further, Japanese Patent Application Laid-open No. Toku-Kai-Hei 10-280932 proposes a slanted OHC (Over-Head Cam) internal combustion engine, in which intake and exhaust valves are disposed below the cylinder axis, a rocker arm is disposed below the intake and exhaust valves, and a push rod is accommodated in a push rod chamber formed along the lower surface of a cylinder. The push rod is connected at the lower end thereof with a tappet driven by a camshaft disposed in a crankcase.

Generally, a valve train chamber for accommodating a rocker arm is formed above a cylinder head. Accordingly, as shown in the disclosure No. Toku-Kai-Hei 4-362270, in case of an engine whose camshaft is disposed above the cylinder axis, a large diameter of a camshaft sprocket projected above makes it difficult to reduce the overall height of the engine.

On the other hand, as disclosed in Toku-Kai-Hei 10-280932, in case of an engine whose rocker arm is disposed below the intake and exhaust valves, since the rocker arm is supported by a rocker shaft provided in the cylinder head, the valve train chamber encloses at least the lower half of the cylinder head, as a result it is impossible to dispose a spark plug at an optimal position for combustion. Particularly, in case of an air-cooled engine, the positional selection of the spark plug is a big problem for its cooling characteristic.

SUMMARY OF THE INVENTION

It is an object of the present invention to provide a slanted internal combustion engine capable of reducing the overall height of the engine and disposing a spark plug at an optimal position in view of the combustion and cooling performance.

An internal combustion engine of which a cylinder is slanted toward a crankcase, comprises intake and exhaust valves provided in a cylinder head and below a combustion chamber and a camshaft provided below the intake and exhaust valves for driving the intake and exhaust valves through a rocker arm.

Further, an air vent is provided at the central part of a casing for accommodating a valve driving mechanism.

DESCRIPTION OF THE PREFERRED EMBODIMENTS

Figure 1:
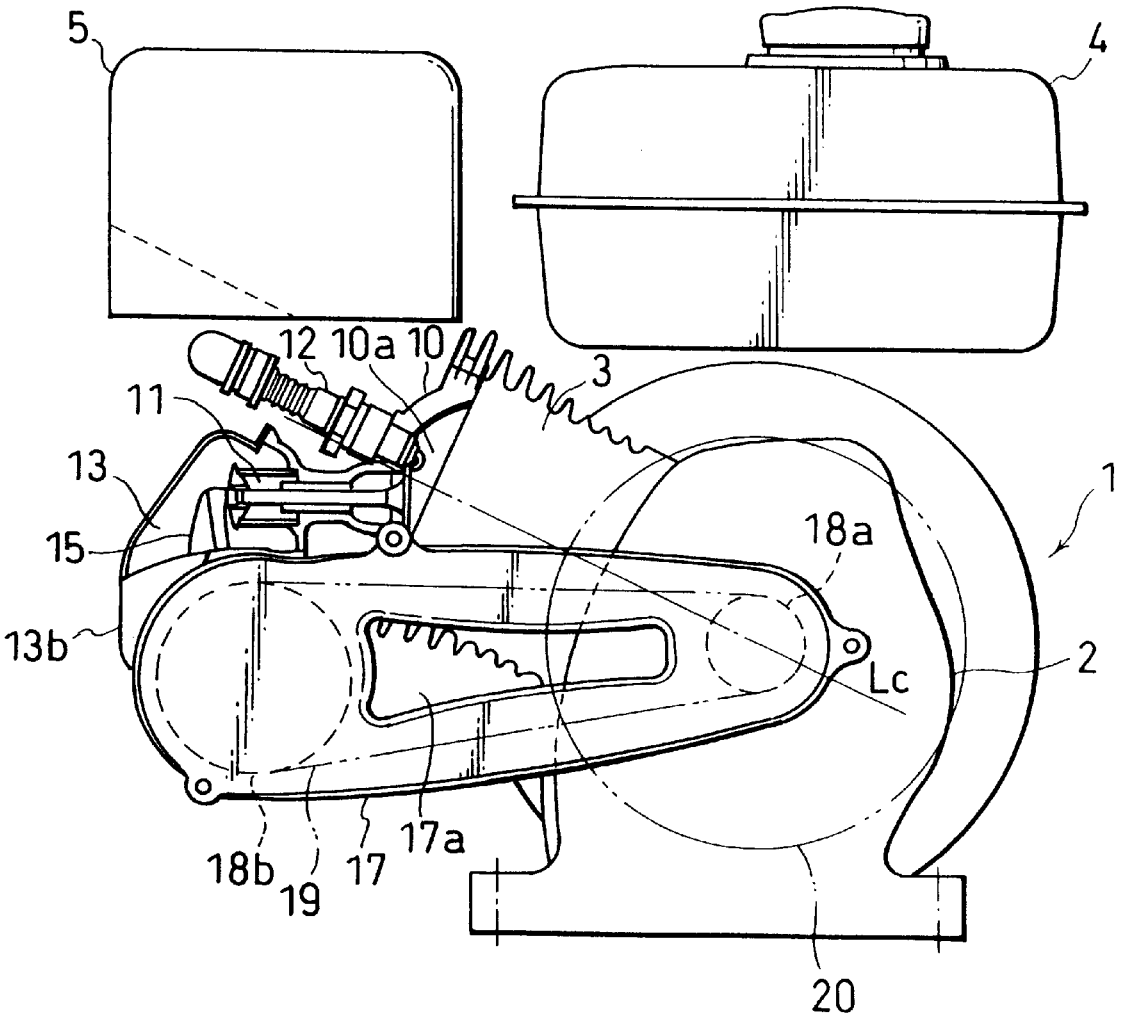
FIG. 1 is a schematic front view of a slanted engine according to an embodiment of the present invention.
Figure 2:
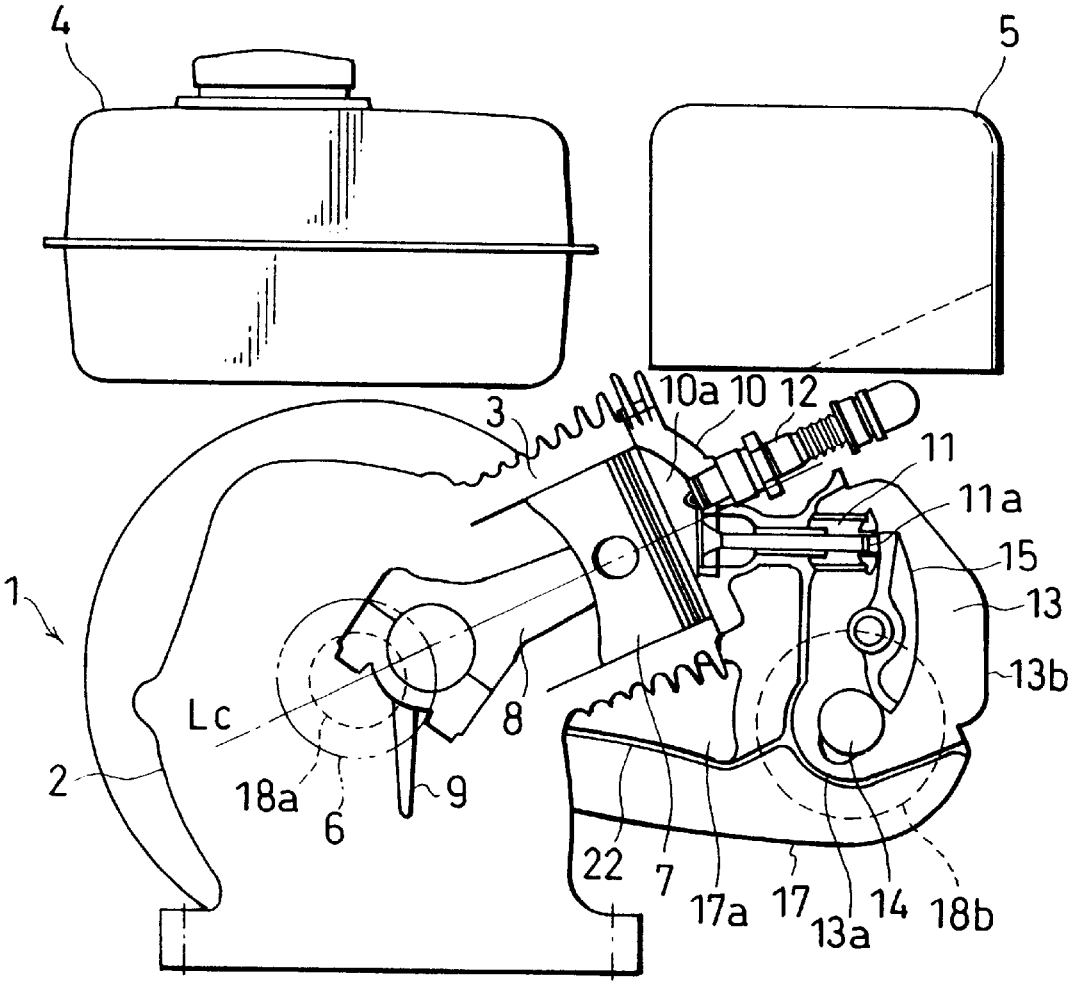
FIG. 2 is a schematic rear view of the slanted engine of FIG. 1.

Referring to FIGS. 1 and 2, reference numeral 1 denotes a slanted SOHC engine, in which a crankcase 2 is integrally formed with a cylinder 3. There are provided a fuel tank 4 and an air cleaner 5 on the engine 1. Further, a muffler and other devices (these are not shown) are disposed around the engine 1.

A crankshaft 6 is provided in the crankcase 2 and a cylinder 3 extends in the diagonal and upper direction of the crankshaft 6. Further, a piston 7 is inserted in the cylinder 3 and is connected with the crankshaft 5 through a connecting rod 8. Reference numeral 9 denotes a dipper for splashing lubrication oil.

The cylinder 3 is inclined at an angle ranging from 60 to 70 degrees with respect to a vertical axis. A combustion chamber 10*a* is formed inside of the cylinder head 10 in which intake and exhaust valves 11 are disposed. Further, a spark plug 12 is disposed near the center of the cylinder head 10 with its electrode exposed in the combustion chamber 10*a*.

The intake and exhaust valves 11 are disposed slidably in an approximately horizontal direction at a position slightly lower than a cylinder center axis Lc and the spark plug 12 is disposed at a position slightly higher than the cylinder center axis Lc and approximately in parallel with the cylinder center axis Lc.

Stem ends 11*a* of the intake and exhaust valves extend in the right direction of FIG. 2. Further, a camshaft 14 is disposed in parallel with the crankshaft 6 at a position lower than the stem ends 11*a* and at a position slightly lower than the crankshaft 6. Further, a rocker arm 15 for pushing the stem ends 11*a* in a synchronizing manner with the rotation of the camshaft 14 is approximately vertically disposed between the stem ends 11*a* and the camshaft 14. The valve train chamber 13 for accommodating the stem ends 11*a,* the camshaft 14 and the rocker arm 15 is formed on the right side of the cylinder head 10 in a position offset below the cylinder center axis Lc.

The valve train chamber 13 is formed of a housing 13*a* integrally formed with the cylinder head 10 and a cover 13*b* for covering an opening of the housing 13*a*.

Reference numeral 17 denotes a belt case which can be divided into a front and rear cases. The rear case is fixed to the engine 1 and the front case is attached to the rear case. The belt case 17 accommodates a valve drive mechanism such as, a timing gear 18*a* mounted on the crankshaft 6, a timing gear 18*b* mounted on the camshaft 14, a timing belt 19 for interconnecting the timing gear 18*a* with the timing gear 18*b* and the like.

As shown in FIG. 1, a trapezoid air vent 17*a* is provided in the belt case 17 between both timing gears 18*a,* 18*b* and at a position having no interference with the timing belt 19, that is, at the central portion of the belt case 17.

Further, a wind guide plate 22 is disposed at the back of the belt case 17 along the bottom surface of the air vent 17*a*. The wind guide plate 22 abuts at one end thereof to the crankcase 2 and abuts at the other end thereof to the housing 13*a* forming the valve train chamber 13. Thus, a wind guide passage for guiding cooling air is formed at the back of the belt case 17 by the cylinder 3, the cylinder head 10, the housing 13*a and the wind guide plate 22.*

An end portion of the crankshaft 6 penetrates the belt case 17 and projects outside. Further, a cooling fan 20 (also acting as a flywheel) is mounted on the end portion of the crankshaft 6. The cooling air generated from the cooling fan 20 is guided along a fan cover (not shown) toward the cylinder 3 and the cylinder head 10 for cooling.

Thus, according to the preferred embodiment of the present invention, since the intake and exhaust valves 11 is disposed below the combustion chamber 10*a* and the camshaft 14 is disposed below the intake and exhaust valves 11, the valve train chamber 13 can be disposed at a position lower than the cylinder head 10, thereby the overall height of the engine 1 can be reduced.

Further, since the valve train chamber 13 is provided below the cylinder head 10, it is possible to dispose the spark plug 12 approximately at the center of the combustion chamber 10*a* and along the cylinder central axis Lc without interfering with the valve train chamber 13. As a result, the combustion is improved and the cooling performance of the spark plug is enhanced.

Further, since the camshaft 14 is disposed at a slightly lower position than the crank shaft 6, the belt case 17 can be arranged on the lower side of the cylinder 3. As a result, the cylinder 3, the cylinder head 10, the spark plug 12 and the like can be exposed to outside over the belt case 17, thereby it is possible to guide the cooling air to these parts directly, this leading to the enhancement of the cooling performance of the engine 1.

In addition to this, since the air vent 17*a* is provided with the belt case 17, it is possible to supply the cooling air to the back side through the air vent 17*a*. Further, since the wind guide passage is formed at the back of the air vent 17*a* by the cylinder 3, the cylinder head 10, the housing 13*a* and the wind guide plate 22, the lower parts of the cylinder 3 and cylinder head 10 and the surrounding parts of the exhaust valve, the exhaust valve seat and the exhaust port can be cooled adequately.

Further, the provision of the air vent 17*a* enables to reduce the weight of the belt case 17, this leading to the overall reduction of the weight of the engine 1.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An internal combustion engine of which a cylinder is slanted toward a crankcase, the engine having a combustion chamber, said combustion chamber disposed inside said cylinder and capped by a cylinder head comprising:

intake and exhaust valves provided in said cylinder head and below said combustion chamber;

a camshaft provided below said intake and exhaust valves for driving said intake and exhaust valves through a rocker arm; and wherein said rocker arm having a first end and a second end opposite said first end, the first end making contact with said intake and exhaust valves and the second end making contact with said camshaft.

2. The internal combustion engine according to claim 1, wherein a spark plug (12) is disposed adjacent to a center line (Lc) of said cylinder (3).

3. An internal combustion engine of which a cylinder is slanted toward a crankcase, the engine having a combustion chamber, said combustion chamber being disposed inside said cylinder and capped by a cylinder head comprising:

intake and exhaust valves provided in said cylinder head and communicating with said combustion chamber;

a camshaft provided below said intake and exhaust valves for driving said intake and exhaust valves through a rocker arm;

a camshaft driving means for driving said camshaft;

a casing for enclosing said camshaft driving means; and an air vent provided at a central part of said casing for directing air toward the cylinder.

4. An internal combustion engine (1) having, a cylinder (3), a cylinder head (10) mounted on and capping said cylinder (3), a combustion chamber (10*a*) located in said cylinder (3) for receiving a reciprocating piston (7), a crankshaft for driving the piston (7) in reciprocating fashion, and a crankcase (2) provided below said cylinder (3) for enclosing the crankshaft (6), comprising:

intake and exhaust valves (11) communicating with said combustion chamber (10*a*);

an endless belt (19), and a camshaft (14) driven by said crankshaft (6) via said endless belt (19), said camshaft (14) located below said intake and exhaust valves (11);

a rocker arm (15) for actuating an opening and closing of said intake and exhaust valves (11), the rocker arm (15) being driven by the camshaft (14); and a casing (17) covering an entire outer periphery of said endless belt (19), the casing having an opening for effectively inducing a cool air to said internal combustion engine (1), wherein a center line (Lc) of said combustion chamber (10*a*) is slanted relative to a horizontal line at a predetermined angle, thereby to reduce the height of said internal combustion engine (1).

5. The internal combustion engine according to claim 4, wherein a spark plug (12) is disposed near the center line of said cylinder.

6. The internal combustion engine according to claim 1, wherein a casing (17) covering an entire outer periphery of an endless belt (19), the casing having an opening for effectively inducing a cool air to said internal combustion engine (1), wherein the camshaft (14) is drivable from said endless belt (19).

7. The internal combustion engine according to claim 4, wherein the casing (17) has a front case and a rear case, said rear case being fixed to the internal combustion engine (1) and said front case being attached to the rear case.

8. The internal combustion engine according to claim 3, further comprising a wind guide plate (22), said wind guide plate (22) is located at a back of the casing (17) along a bottom surface of the air vent (17*a*) for directing said air toward the cylinder (3).

9. The internal combustion engine according to claim 4, further comprising a wind guide plate (22), said wind guide plate (22) is located at a back of the casing (17) for directing said air to said combustion engine (1).

10. The internal combustion engine according to claim 4, wherein the predetermined angle is in the range of 20°–30° with respect to the horizontal line.

11. The internal combustion engine according to claim 4, wherein the intake and exhaust valves (11) are positioned slightly lower than the center line (Lc) of the combustion chamber (10*a*), and a spark plug is positioned slightly higher than the center line (Lc) of the combustion chamber (10*a*).

12. The internal combustion engine according to claim 3, wherein a spark plug (12) is disposed near a center line (Lc) of said cylinder (3).

13. The internal combustion engine according to claim 3, wherein the casing has a front case and a rear case, said rear case being fixed to the internal combustion engine (1) and said front case being attached to the rear case.

14. The internal combustion engine according to claim 3, wherein the cylinder (3) is slanted in the range of 20°–30° with respect to a horizontal line.

15. The internal combustion engine according to claim 3, wherein the intake and exhaust valves (11) are positioned slightly lower than a center line (Lc) of the combustion chamber (10*a*), and a spark plug (12) is positioned slightly higher than the center line (Lc) of the combustion chamber (10*a*).

* * * * *